US010319540B2

(12) United States Patent
Weber et al.

(10) Patent No.: US 10,319,540 B2
(45) Date of Patent: Jun. 11, 2019

(54) ELECTRICAL INSTALLATION SWITCHING DEVICE HAVING A SWITCHING POSITION DISPLAY

(71) Applicant: ABB Schweiz AG, Baden (CH)

(72) Inventors: Ralf Weber, Heidelberg (DE); Erwin Muders, Heidelberg (DE); Klaus-Peter Eppe, Waldbrunn (DE)

(73) Assignee: ABB SCHWEIZ AG, Baden (CH)

( * ) Notice: Subject to any disclaimer, the term of this patent is extended or adjusted under 35 U.S.C. 154(b) by 15 days.

(21) Appl. No.: 15/586,298

(22) Filed: May 4, 2017

(65) Prior Publication Data

US 2017/0323741 A1 Nov. 9, 2017

(30) Foreign Application Priority Data

May 4, 2016 (DE) ..... 10 2016 108 292

(51) Int. Cl.

| | |
|---|---|
| ***H01H 9/00*** | (2006.01) |
| ***H01H 9/16*** | (2006.01) |
| ***H01H 9/20*** | (2006.01) |
| ***H01H 19/36*** | (2006.01) |
| ***H01H 71/52*** | (2006.01) |
| *H01H 71/40* | (2006.01) |

(52) U.S. Cl.

CPC ..... *H01H 9/16* (2013.01); *H01H 9/20* (2013.01); *H01H 19/36* (2013.01); *H01H 71/526* (2013.01); *H01H 71/40* (2013.01); *H01H 2221/036* (2013.01)

(58) Field of Classification Search

CPC .. H01H 9/16; H01H 9/20; H01H 9/26; H01H 19/36; H01H 75/12; H01H 81/00; H01H 83/00; H01H 77/00

USPC ..... 335/174

See application file for complete search history.

(56) References Cited

U.S. PATENT DOCUMENTS

2007/0034495 A1* 2/2007 Christmann ..... H01H 71/526 200/400

2007/0046404 A1* 3/2007 Christmann ..... H01H 71/40 335/35

(Continued)

FOREIGN PATENT DOCUMENTS

DE 102008006863 A1 1/2009

*Primary Examiner* — Shawki S Ismail

*Assistant Examiner* — Lisa N Homza

(74) *Attorney, Agent, or Firm* — Leydig, Voit & Mayer, Ltd.

(57) ABSTRACT

An electrical installation switching device has an insulating material housing; a switching knob protruding beyond the housing on a housing front face and able to pivot between a switched-on and switched-off position about a first pivot axis; a magnetic short circuit current and/or a thermal excess current trigger; a contact site formed from a fixed and a moveable contact piece, a switching lock having a latching site and being triggerable by an excess and/or short circuit current using the trigger when unlatching the latching site; an operator pivotable between a release and an operating position about a second pivot axis, aligned parallel to the first pivot axis, switching knob having an operating contour, the operator and operating contour cooperating by triggering the switching lock using the trigger when the operator pivots about the second pivot axis to hold the knob in an intermediate position between the on and off position.

8 Claims, 8 Drawing Sheets

(56) References Cited

U.S. PATENT DOCUMENTS

| | | | | |
|---|---|---|---|---|
| 2008/0001687 | A1* | 1/2008 | Weber | H01H 71/526<br>335/21 |
| 2008/0290971 | A1* | 11/2008 | Weber | H01H 71/40<br>335/35 |
| 2012/0182095 | A1* | 7/2012 | Wendel | H01H 71/2418<br>335/18 |
| 2018/0218852 | A1* | 8/2018 | Weber | H01H 9/342 |

* cited by examiner

ELECTRICAL INSTALLATION SWITCHING DEVICE HAVING A SWITCHING POSITION DISPLAY

CROSS-REFERENCE TO RELATED APPLICATIONS

Priority is claimed to German Patent Application No. DE 10 2016 108 292.9, filed on May 4, 2016, the entire disclosure of which is hereby incorporated by reference herein.

FIELD

The invention is based on an electrical installation switching device, which may. be used by way of example in circuit breakers, fault current circuit breakers or motor circuit breakers.

BACKGROUND

A circuit breaker in general comprises an insulating material housing having a front face, a fastening face, two narrow faces and two broad faces. At least one contact site is located within the insulating material housing, said contact site being formed from a fixed contact piece and a contact piece that can move, wherein the contact piece that can move is held on a contact lever that is mounted in such a manner that it can pivot. Moreover, such an installation switching device comprises a magnetic short circuit current trigger or a thermal excess current trigger, or both a magnetic short circuit current trigger as well as a thermal excess current trigger.

The switching knob protrudes beyond the front face of the housing. The switching knob is mounted in the housing near to the front face on a pivoting axis in such a manner that said switching lever can pivot. The switching knob, the magnetic short circuit current trigger and/or the thermal excess current trigger are operatively connected to a switching lock having a latching site. The latching site is formed between a trigger lever and a ratchet lever. The trigger lever can pivot between a latching position and an unlatching position, either under the influence of the switching knob or under the influence of one of the two triggers. The switching lock is also operatively connected to the contact lever. One advantageous embodiment possibility for such a switching lock is disclosed and described in DE 10 2008 006 863 A1.

The switching knob can be manually pivoted into a switched-on position and into a switched-off position. The switched-on position of the switching knob corresponds in the case of unhindered operation to a closed contact site. The switching lock influences the contact lever in such a manner that the contact piece that can move is pushed with the required contact pressure force against the fixed contact piece.

The switched-off position of the switching knob corresponds to an opened contact site.

SUMMARY

An aspect of the invention provides an electrical installation switching device, comprising: an insulating material housing; a switching knob protruding beyond the insulating material housing on a front face of the insulating material housing, the switching knob configured to pivot between a switched-on position and a switched-off position about a first pivot axis; a magnetic short circuit current trigger and/or a thermal excess current trigger; a contact site formed from, and including, a fixed contact piece and a contact piece that can move; a switching lock including a latching site, the switching lock being triggerable in the event of an excess current and/or short circuit current using the excess current trigger and/or the short circuit current trigger when unlatching the latching site; and an operator configured to pivot between a release position and an operating position about a second pivot axis, is the second pivot access being aligned parallel to the first pivot axis, wherein the switching knob includes an operating contour, and wherein the operator and the operating contour cooperate in the event of the switching lock being triggered by the excess current trigger and/or a short circuit current trigger when the operator is pivoting about its pivot axis so as to hold the switching knob in an intermediate position between the switched-on position and the switched-off position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
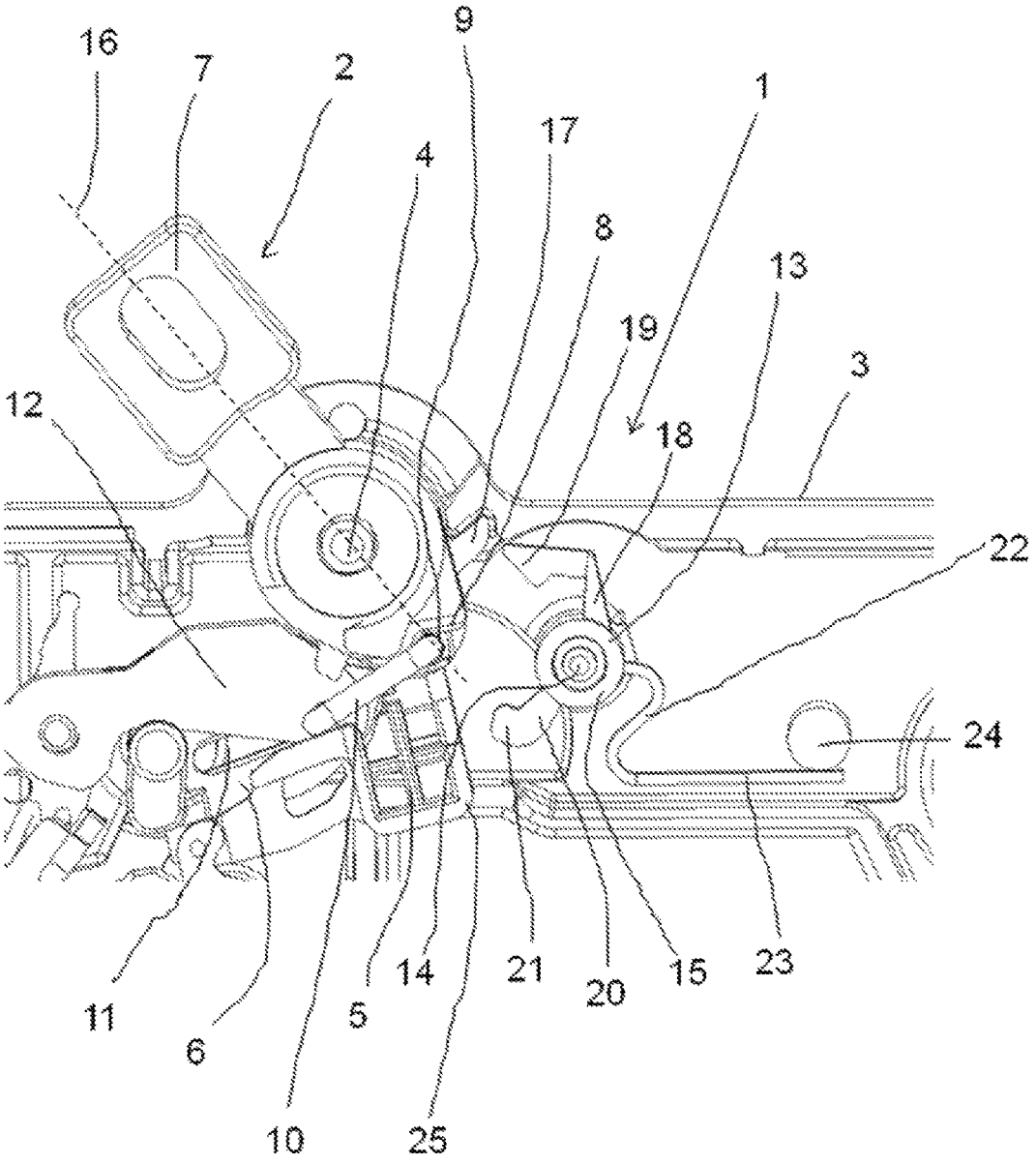
FIG. 1 schematically, and in an exemplary manner, a view of a region around the switching knob in an installation switching device in accordance with a first embodiment of the invention, wherein the switching knob is located in the switched-off position.

An aspect of the present invention is to improve an installation switching device in such a manner that with little constructive expenditure the switching knob is held after triggering in an intermediate position between the switched-on and the switched-off position so that it is evident from the outside that the short circuit trigger or the excess current trigger has been triggered.

An aspect of the invention is achieved by virtue of an installation switching device. comprising an operating means that can be pivoted between a release position and an operating position about a second pivot axis that is aligned parallel to the first pivot axis of the switching knob, wherein the switching knob comprises an operating contour, wherein the operating means and the operating contour of the switching knob cooperate in the event of the switching lock being triggered by means of the excess current trigger and/or short circuit current trigger when the operating means is pivoting about its pivot axis so as to hold the switching knob in an intermediate position between the switched-on and the switched-off position. The solution in accordance with the invention only requires one additional component that is operatively coupled to the switching lock and the switching knob. Constructively, the expenditure is therefore particularly low, the switching lock of a known device, by way of example disclosed in DE 10 2008 006 863 A1 can to a large extent remain unchanged, it is only necessary to suitably adjust the additional operating means.

In accordance with an advantageous embodiment, the operating means is a double arm lever that can be mounted in such a manner that it can pivot and the first lever arm of said double arm lever supports a latching projection on the free end of said lever arm as a coupling site for cooperating with the operating contour of the switching knob, and the second lever arm of said double arm lever forms an obtuse angle with the first lever arm and the free end of said double arm lever forms the couple site for operatively coupling to the switching lock.

In accordance with an advantageous embodiment, the return element is fixedly connected to the operating means and is formed with an S-shaped folded, elastically deformable strip material. It is thereby rendered possible to accommodate the return element in a space-saving manner. The operating means, connected to the return element, can be embodied as a pre-assembled construction unit. By way of example, the operating means can be produced together with the return element as a synthetic material injection moulded part.

In accordance with an advantageous embodiment, the operating means is embodied with a display carrier that has a first and a second display section for displaying at least two different positions of the operating means. In an advantageous further development, a viewing window is attached to the front face of the housing in the region of the display carrier so as to view at least one of the display sections.

In accordance with one advantageous embodiment, a further latching site is present between the housing and the operating means and the operating means is held in its operating position by means of being latched at said latching site. Only if the further latching site is unlatched can the operating means be pivoted into its release position.

In accordance with one advantageous embodiment, the return means is embodied in order to influence the operating means with a returning resilient force in the direction of the release position of the operating means and in order to influence the operating means with an axially-acting resilient force into the latching position of the second latching site. For this purpose, in one advantageous further development the return means is embodied as a helical resilient element having two operating arms that in each case protrude at the end in a radial manner.

Further advantages and advantageous embodiments of the invention are disclosed in the dependent claims.

FIG. 1 is initially described. FIG. 1 illustrates schematically and in an exemplary manner a view of a region around the switching knob 2 in an installation switching device 1 in accordance with a first embodiment of the invention, wherein the switching knob 2 is located in the switched-off position.

The installation switching device 1 is a circuit breaker. A circuit breaker in general comprises an insulating material housing having a front face 3, a fastening face, two narrow faces and two broad faces. At least one contact site is located within the insulating material housing, said contact site being formed from a fixed contact piece and a contact piece that can move, wherein the contact piece that can move is held on a contact lever 2 that is mounted in such a manner that it can pivot. Moreover, such an installation switching device comprises a magnetic short circuit current trigger or a thermal excess current trigger, or both a magnetic short circuit current trigger as well as a thermal excess current trigger.

The switching knob 2 protrudes beyond the front face 3 of the housing. The switching knob is mounted in the housing near to the front face 3 on a pivoting axis 4 in such a manner that said switching knob can pivot. In FIG. 1, only one device section near the front face 3 in the vicinity of the switching knob 2 is illustrated.

The switching knob 2, the magnetic short circuit current trigger and/or the thermal excess current trigger are operatively connected to a switching lock having a latching site (not illustrated) as is known in principle. The latching site is formed between a trigger lever 5 and a further lever 6. The further lever 6 is also referred to as a ratchet lever. The trigger lever can pivot between a latching position and an unlatching position, either under the influence of the switching knob or under the influence of one of the two triggers. The switching lock is also operatively connected to the contact lever. One advantageous embodiment possibility for such a switching lock is disclosed and described in DE 10 2008 006 863 A1.

The switching knob can be manually pivoted into a switched-on position and into a switched-off position. The switched-on position of the switching knob corresponds in the case of unhindered operation to a closed contact site. The switching lock influences the contact lever in such a manner that the contact piece that can move is pushed with the required contact pressure force against the fixed contact piece. The switched-off position of the switching knob corresponds to an opened contact site.

The switching lock functions in its function and operative connection to the switching knob and the contact lever as follows. As a starting position, a position is assumed in which the switching knob is located in the switched-off position, then the contact lever is pivoted away from the fixed contact piece. The latching site is latched. The switching knob is now pivoted from the switched-off position into the switched-on position. The switching lock can convert the pivoting movement of the switching knob from the switched-off position into the switched-on position into a pivoting movement of the contact lever towards the fixed contact piece because the latching site is latched. Different constructive and functional approaches for achieving this function are known to the person skilled in the art. The latching site of the switching lock remains latched. The switching knob is now pivoted from the switched-on position back into the switched-off position so as to perform a manual switch off procedure. The switching knob acts upon the trigger lever in such a manner that said trigger lever is pivoted into its unlatching position. The latching site in the switch gear is consequently unlatched. In the case of an unlatched latching site, the switching lock ensures that the contact lever opens the contact site.

The switching knob is influenced by a resilient element, which engages with said switching knob in a corresponding manner, by means of the returning resilient force of said resilient element in the direction of the switched-off position of said switching knob.

The switching lock further ensures that accordingly, if in other words the contact site has been opened, the latching site is latched in the case of a further opened contact site if a triggering procedure has not occurred. The switching device is thereby prepared to be switched-on again.

If in the switched-on state, the short circuit triggering procedure or the excess current triggering procedure is performed, the following occurs. The operating connection between each of the triggers that are present and the switching lock ensure that in the event of a triggering procedure the trigger lever is pivoted into its unlatching site. The latching site is unlatched, the switching lock ensures that the contact site is opened. The switching knob is pivoted by the above mentioned resilient element into the switched-off position of said switching knob. As long as the trigger lever is held by the corresponding trigger in the unlatching position of said trigger lever, the latching site remains unlatched. The switching knob 2 is in a free-wheeling state. If the switching knob is pivoted in this state in the case of an unlatched unlatching site into the switched-on position, this has no effect on the contact lever. The switching knob is always pivoted back by means of the above mentioned resilient element into the switched-off position of said switching knob.

The switching knob comprises on its end that points outwards a switching grip 7. Two projections that are formed as fork-shaped are located on the side lying opposite the switching grip 7, only one of said projections is visible with reference numeral 8. The two projections release a receiving chamber that is open on one side. Each of the two projections comprises on its end that is remote from the switching grip 7 an eye-shaped aperture 9. The longitudinal central axis of the switching knob 2 extends through the central point of the eye-shaped apertures 9. A first arm of a link element 10 engages in the eye-shaped aperture 9. A second arm of the link element 10 engages in an elongated hole 11 of the latching lever 6. The second arm of the link element 10 is moreover connected in an articulated manner to a free end of an intermediate lever 12. The intermediate lever 12 forms a connection to the contact pressure resilient element and the contact lever. The contact lever 5 can be latched to the projections 8 of the switching knob 2 in such a manner that said switching knob can pivot and said contact lever 5 is also coupled by way of the link element 10 to the latching lever 6 and the intermediate lever 12.

In the above-described arrangement that is known to a great extent from the prior art, by way of example the previously mentioned DE 10 208 006 863 A1, if the switching knob is located in its switched-off position, it is not possible to identify from the position of the switching knob from the outside, whether the switching device was manually switched off or the switching device has arrived in the switched-off position owing to a short circuit triggering procedure or excess current triggering procedure.

The object of the present invention is to improve an installation switching device in such a manner that with little constructive expenditure the switching knob is held after a triggering procedure in an intermediate position between the switched-on and the switched-off position so that it is evident from the outside that the short circuit trigger or the excess current trigger has been triggered.

Figure 2:
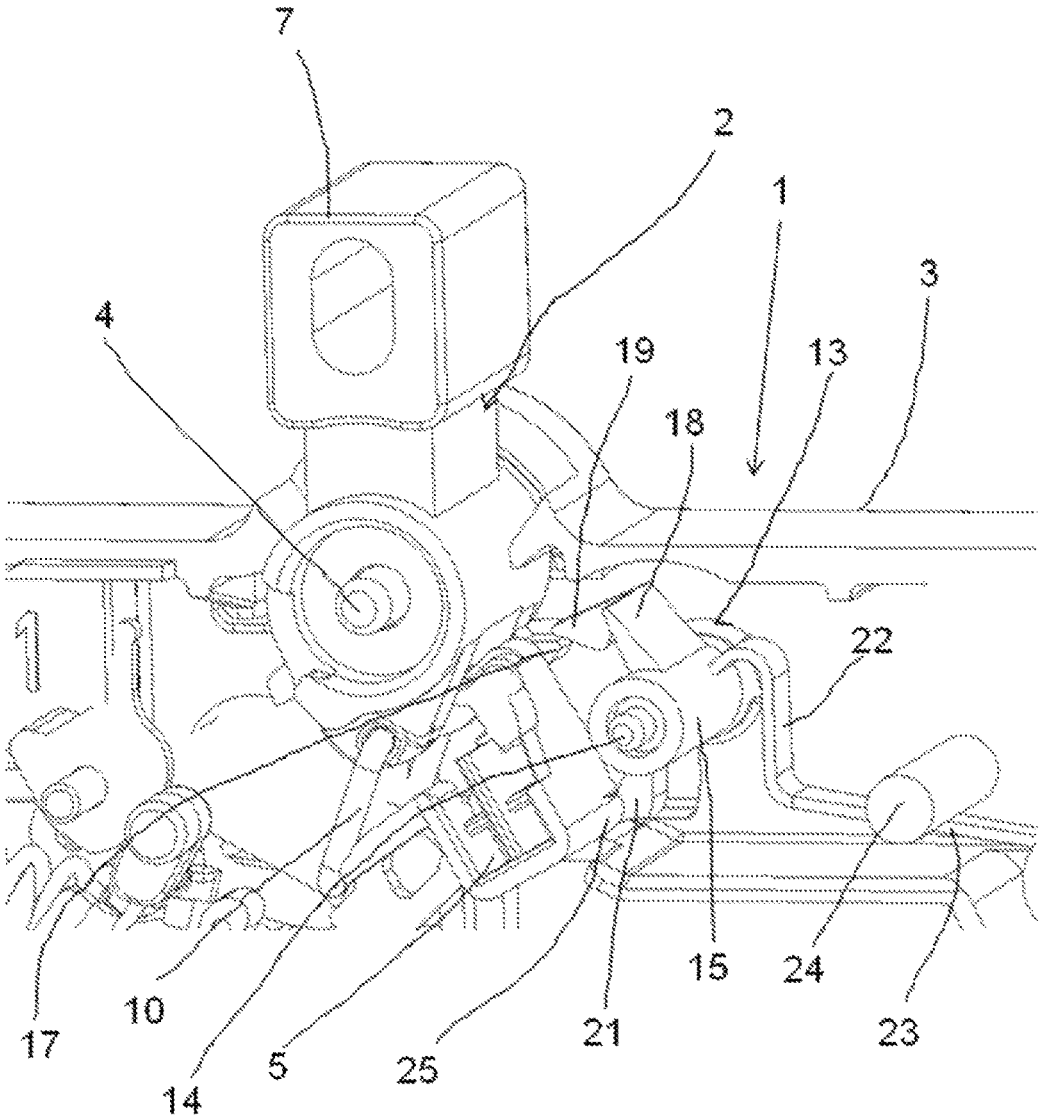
FIG. 2 schematically, and in an exemplary manner, a view of a region around the switching knob in an installation switching device in accordance with a first embodiment of the invention, wherein the switching knob is located in the tripped position.
Figure 3:
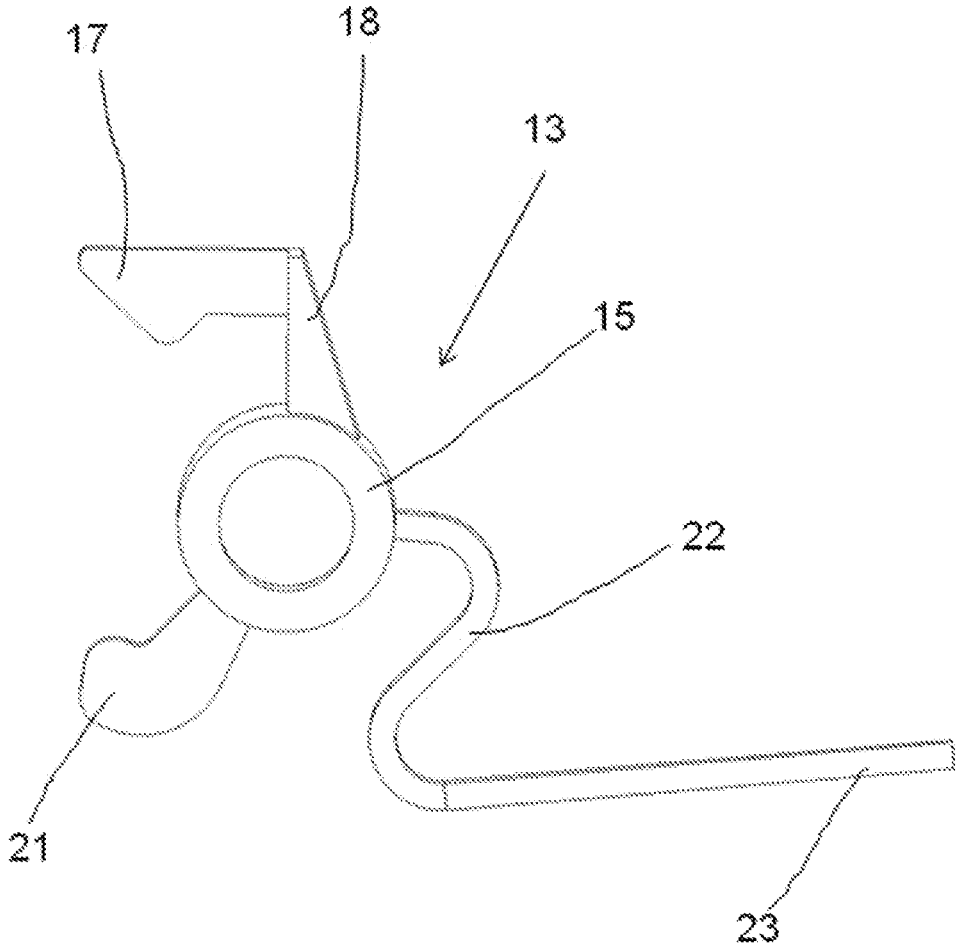
FIG. 3 schematically, an operating means, such as that used in the installation switching device in accordance with FIGS. 1 and 2.

For this purpose, an operating means 13 is present in the installation device, see also FIG. 3. The operating means 13 is embodied in the form of a double arm lever that is mounted in such a manner that it can pivot about a pivot axis 14 that is fixed to the housing. The pivot axis 14 is aligned approximately parallel to the pivot axis 4 of the switching knob 2. The operating means 13 sits in such a manner that it can pivot with a hub 15 that is in an approximately cylindrical form on the pivot axis 14 that is fixed to housing. The pivot axis 14 that is fixed to the housing is located in relation to the trigger lever 5 on the opposite side of the intended extension of the longitudinal central axis 16 of the switching knob 2 in the switched-off position of the switching knob. The operating means 13 can pivot between a release position, illustrated in FIG. 1, and an operating position, illustrated in FIG. 2.

An additional operating contour 17 is attached to the switching knob 2, by way of example is moulded on in the synthetic material injection moulding method. The operating contour 17 has the function in cooperation with the operating means 13 of holding the switching knob 2 in an intermediate position between the switched-on position and the switched-off position after a triggering procedure so as to display the triggering procedure. The operating contour is embodied in this case as a radially-protruding mandrel or beam having a rounded end contour.

Two levers that lie opposite in relation to the pivot axis 14 are formed on the cylindrical hub 15 of the operating means 13. A first lever is referred to as a blocking lever 18. The blocking lever points in the release position of the operating means 13 in the direction of the front face 3 of the housing. The blocking lever supports on its free end a latching projection 19. The latching projection 19 is embodied as a projection having a rounded end contour and said latching projection points at an approximate right angle on the free end of the blocking lever 18 from said blocking lever in the direction of the switching knob 2.

A second lever that is formed on the cylindrical hub 15 is referred to as the actuating lever 20. The actuating lever forms an obtuse angle with the blocking lever 18. The actuating lever supports on its free end an actuating projection 21 having a rounded end contour. The actuating projection 21 forms the coupling site for operatively coupling to the switching lock. The coupling occurs on faces of the switching lock by way of the trigger lever 5.

The operating means 13 is coupled to a return means 22. The return element 22 ensures that the operating means 13 is influenced with a returning resilient force in the direction of its release position after pivoting out of its release position into its operating position. In the embodiment as is illustrated in FIGS. 1 and 2, the return element 22 is embodied as an approximately S-shaped curved return spring. This return spring is formed in a region between the blocking lever 18 and the actuating lever 20 on the hub 15, by way of example in a synthetic material injection moulding procedure as a synthetic material resilient element. As is illustrated in FIG. 3, the operating means 13 is embodied in this embodiment as a single synthetic material injection moulded part. The return resilient element 22 is fixed on its free end 23 to a pin 24 that is fixed to the housing.

The function in accordance with the embodiment that is illustrated in the FIGS. 1 to 3 is as follows. In the event of a triggering procedure, be it as a result of the thermal excess current triggering procedure, be it as a result of the magnetic short circuit triggering procedure, the affected trigger ensures in cooperation with the switching lock that the trigger lever 5 is pivoted anticlockwise. The latching site between the trigger lever 5 and the latching lever 6 is unlatched. Up until the moment in which the unlatching takes place, the trigger lever 5 is not in contact with the operating means 13.

After the unlatching procedure, the switching lock construction ensures that the latching lever 6 pivots clockwise. By way of the link element 10, the latching lever pushes the trigger lever 5 anticlockwise. In this further anticlockwise pivoting movement, the trigger lever 5 with its rounded edge 25 that is facing the operating means 13 makes physical contact with the actuating projection 21 of the operating means 13. The operating means 13 is consequently pivoted anticlockwise out of its release position into its operating position. As a consequence, the latching projection 19 arrives at the blocking lever 18 in the pivoting path of the operating contour 17 on the switching knob 2. The switching knob 2 had started, namely after unlatching the latching site, driven by the above mentioned return spring, to move on the pivoting path from the switched on position to the switched off position. Along this path, the operating contour 17 on the switching knob thus 2 makes physical contact with the latching projection 19 on the blocking lever 18 of the operating means 13. As a consequence, the switching knob 2 is prevented from pivoting further.

The switching knob 2 remains when viewed from the outside in a central position between the switched-on position and the switched-off position. From the outside, a user consequently sees from the switching knob that is held in the central position that the contact site of the installation switching device has opened, owing to a triggering procedure, not as a result of a manual shut down.

The switching knob together with said switching knob the operating contour 17 are further influenced in this central position with a force by means of the return resilient element that is acting upon the switching knob and said force attempts to pivot the switching knob anticlockwise. The trigger lever 5 however holds the operating means 13 in its blocking position. As a consequence, in the central position of the switching knob the switching knob blocks the operating means. It is thereby ensured that the switching knob is held in the central position that displays a triggering procedure. The contact site remains open. The latching site remains unlatched.

In order to close the contact site of the installation switching device 1, it is necessary to overcome the blockade of the switching knob 2 with the operating means 13. The blockade is overcome manually by means of an operator from the outside. It is necessary for this purpose initially to force the switching knob 2 on its switching grip 7 manually out of the central position that is illustrated in FIG. 2 and into its switched-off position that is illustrated in FIG. 1. The force that is exerted by the operating person from the outside overcomes the blockade of the switching knob 2 with the operating means 13. The outer, rounded end of the operating contour 17 of the switching know 2 is forced for this purpose to some extent to slide over the rounded end of the latching projection 19 on the blocking lever 18. The switching knob 2 can now move into its switched-off position, see FIG. 1. The latching site is now latched. The return resilient element 22 ensures that the operating means 13 again pivots clockwise into its release position. The installation switching device 1 is now ready to be switched back on at the switching knob 2.

A further embodiment is taken into consideration with reference to the FIGS. 4 to 8. The embodiment as illustrated in the FIGS. 4 to 8 differs from the embodiment in accordance with the above-mentioned FIGS. 1 to 3 by virtue of the fact that:

a) The operating means 113 additionally comprises a display carrier 33 having a first and a second display section 32, 34, b) A viewing window 31 is attached to the front face 3 of the housing in the region of the display carrier 33.

c) A further latching site is present between the housing and the operating means 113 and the operating means 113 is held in its operating position by means of being latched at said latching site.

d) The return element performs two functions, namely firstly influencing the operating means 113 with a returning resilient force, which acts in the peripheral direction, in the direction of the release position of the operating means 113 and secondly influencing the operating means 113 with an axially-acting resilient force into the latching position of the second latching site.

Figure 8:
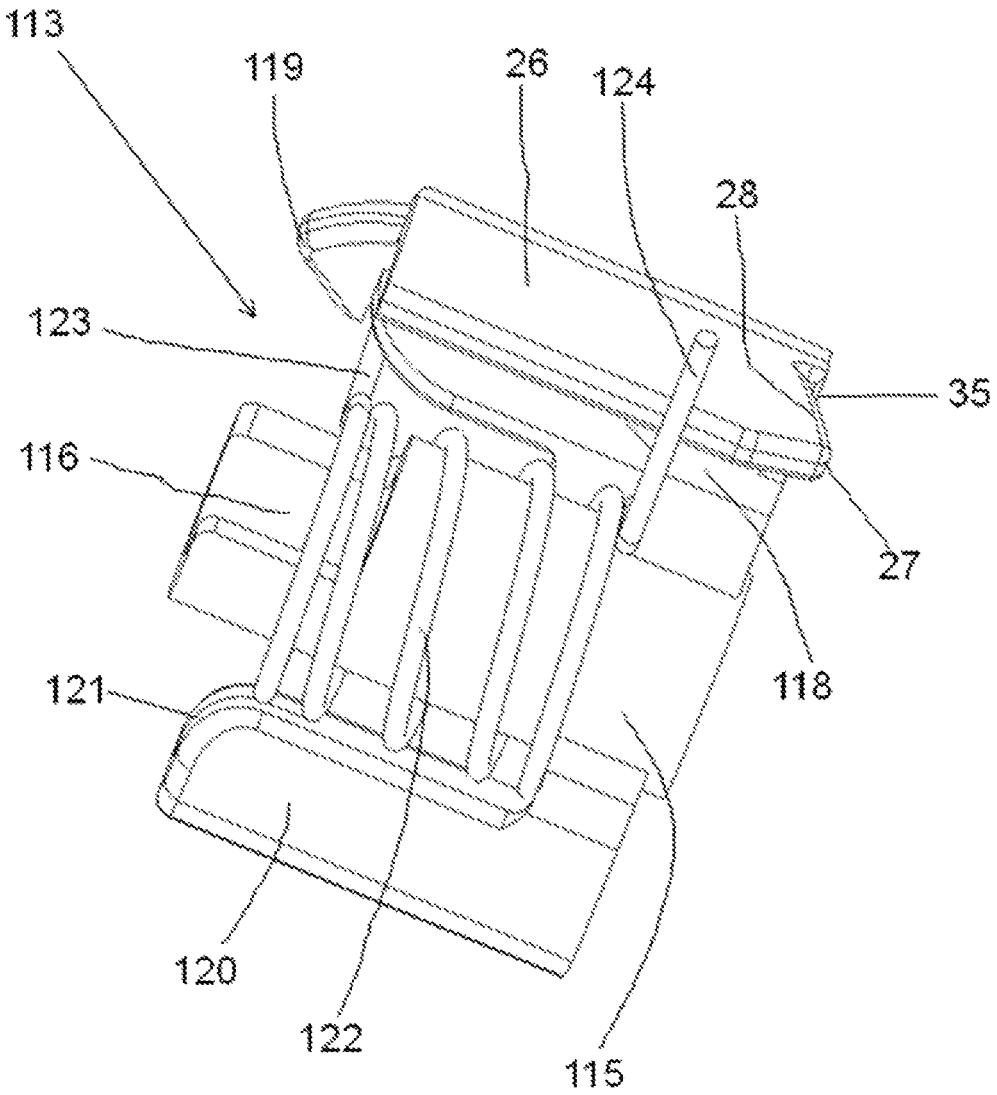
FIG. 8 schematically, an operating means in a second embodiment, such as that used in the installation switching device in accordance with the second embodiment.

FIG. 8 illustrates the operating means 113 in the second embodiment in an isolated view. This is based on a hub part 115 that is approximately cylindrical and comprises a central hole 116 for placing the operating means 113 onto the pivot axis 14 that is fixed to the housing, see also for this purpose FIGS. 4 and 6. The blocking lever 118 is formed on the hub 115, said blocking lever 118 supporting the latching projection 119 on its free end. The blocking lever 118 additionally supports a display carrier 26. The blocking lever is embodied as a plate that is bent in the manner of a section of a cylinder periphery. As in particular the FIGS. 4 and 6 make clear, the peripheral surface of the display carrier 26 extends essentially parallel to the peripheral surface of the hub 115. The display carrier 26 also pivots with the pivoting of the operating means 113. The latching projection 119 is located on a free end of the display carrier 26.

Figure 4:
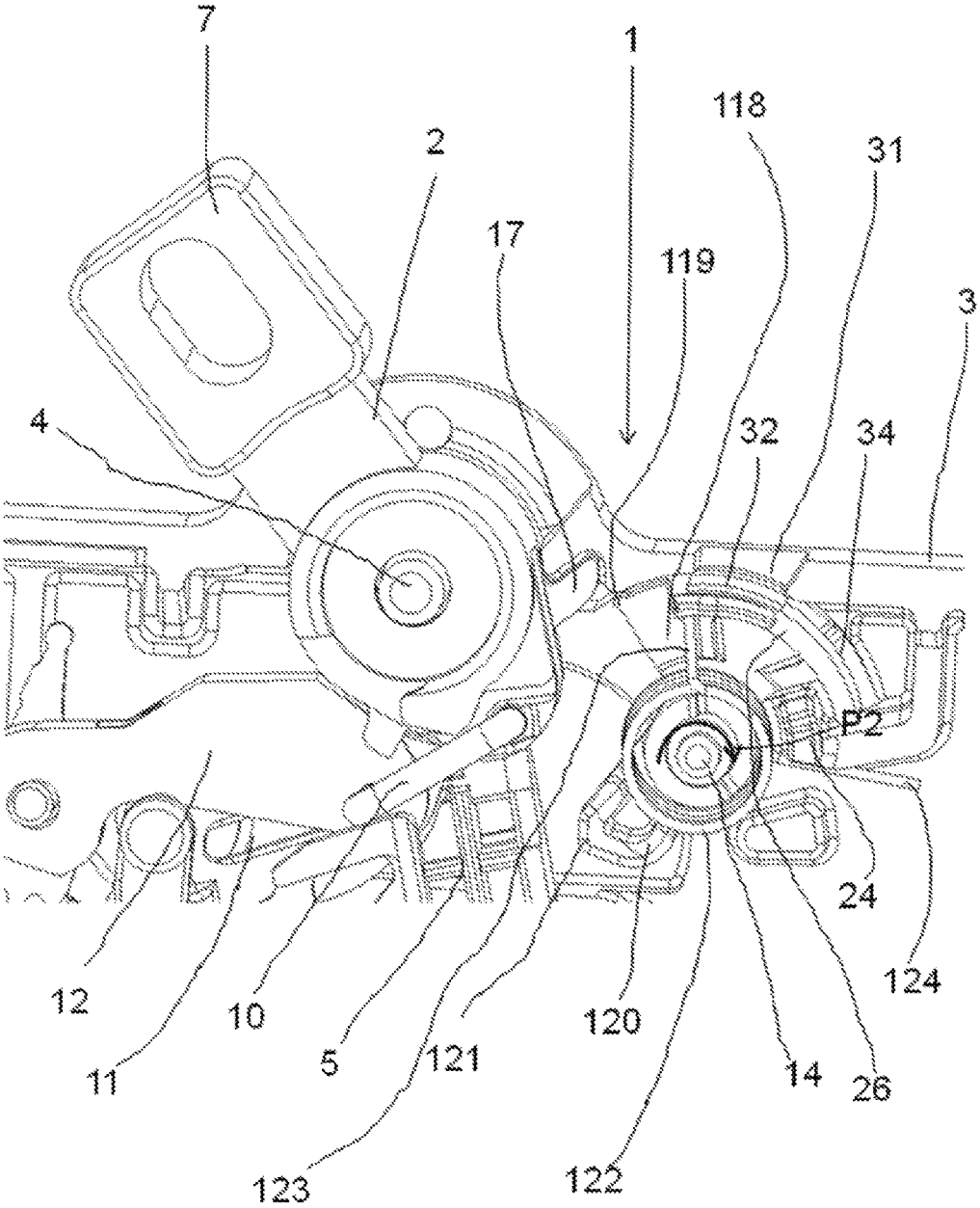
FIG. 4 schematically, and in an exemplary manner, a view of a region around the switching knob in an installation switching device in accordance with a second embodiment of the invention, wherein the switching knob is located in the switched-off position.
Figure 6:
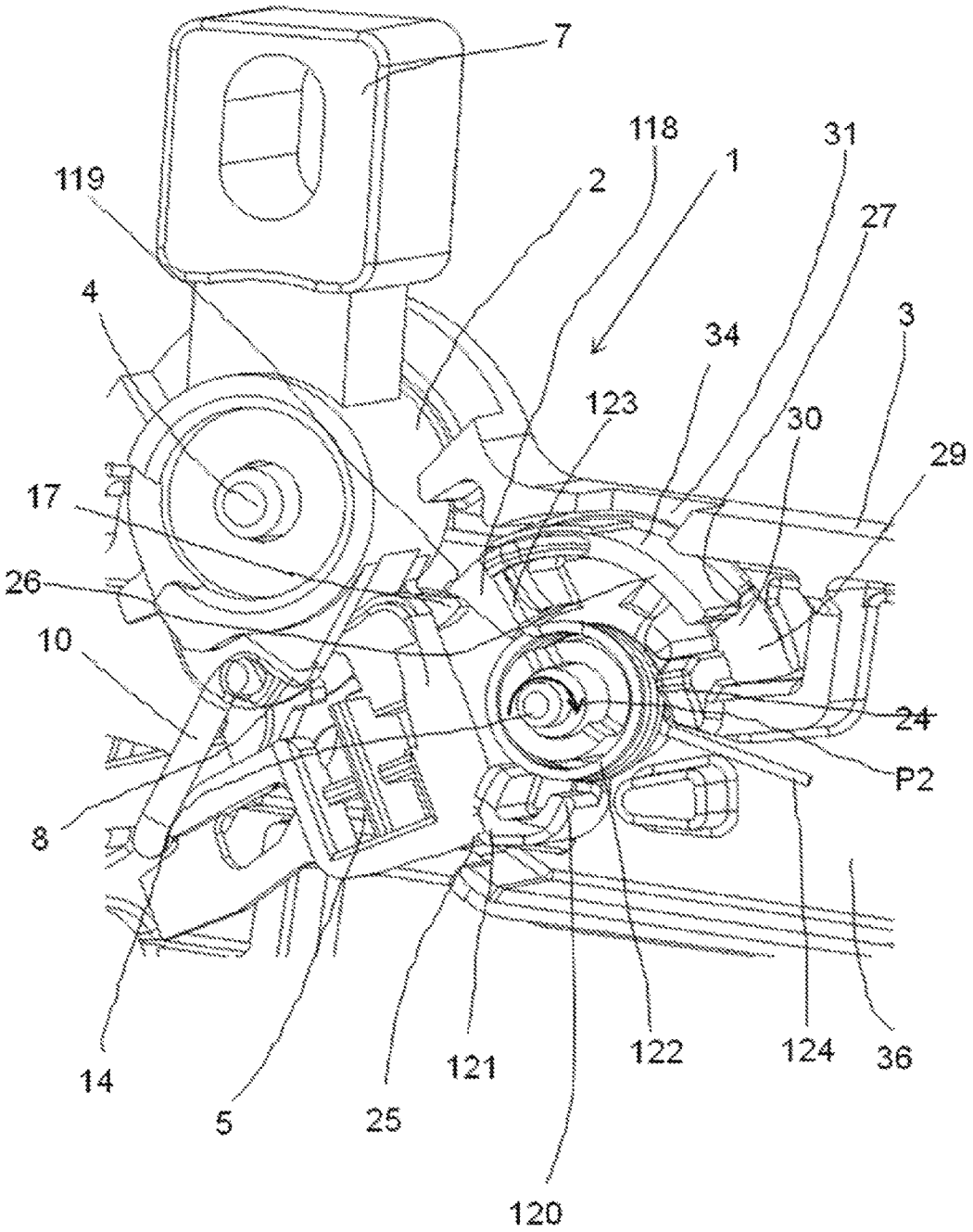
FIG. 6 schematically, and in an exemplary manner, a view of a region around the switching knob in an installation switching device in accordance with the second embodiment of the invention, wherein the switching knob is located in the tripped position.
Figure 7:
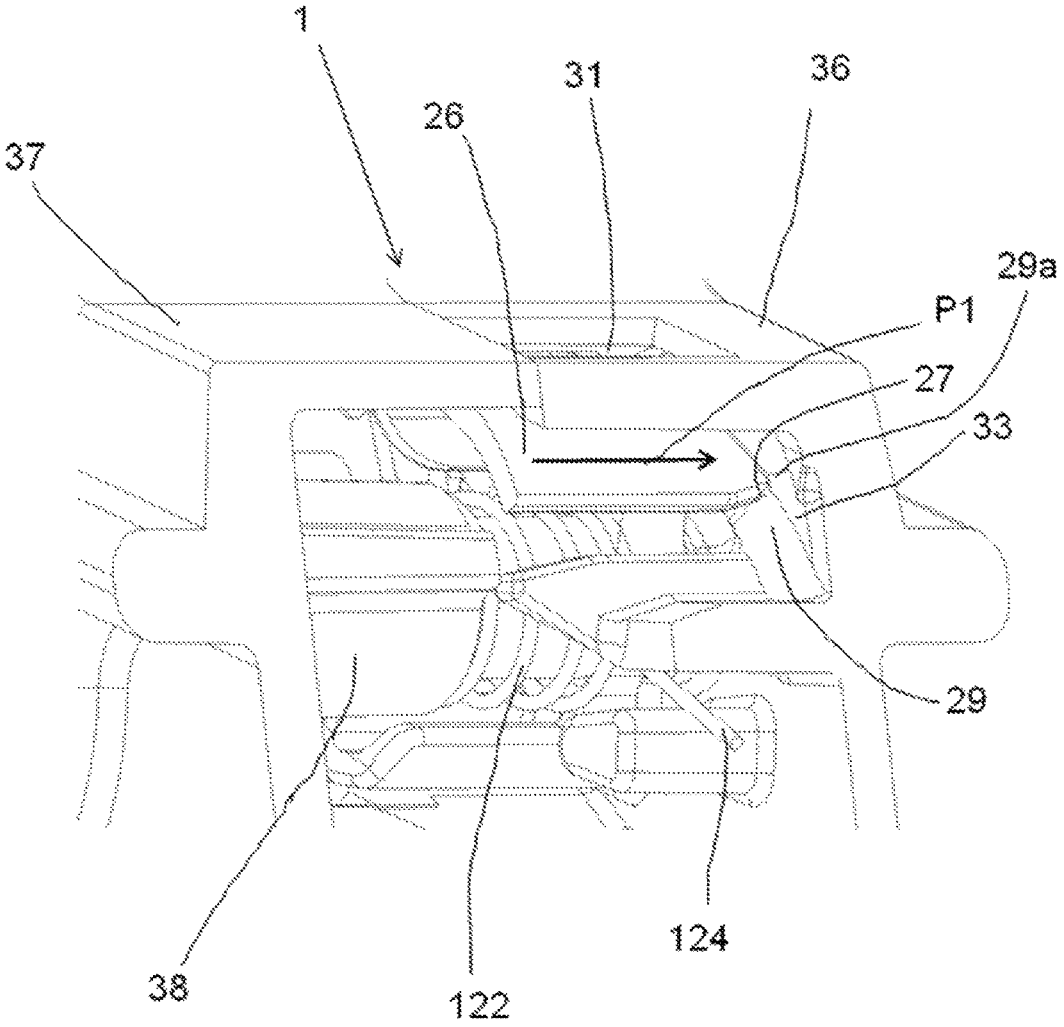
FIG. 7 a view of the in part cut away front face of an installation switching device in accordance with the second embodiment of the invention, in the region of the operating means, wherein the switching knob is located in the tripped position.

A viewing aperture 31 is located in the front face 3 of the housing of the installation switching device 1 and a section of the display carrier 26 is visible through said viewing aperture. A first display section 32 is visible in the release position of the operating means 113 that is illustrated in FIG. 4. This display carrier could be by way of example a specific colour, for example green, in order to display with this colour that a triggering procedure has not occurred. In the operating position that is illustrated in FIG. 6 into which the operating means has moved after a triggering procedure, the display carrier 26 has been pivoted anticlockwise. A second display section 34 that is located in the clockwise direction adjacent to the first display section 32 on the display carrier is now visible. The second display section 34 can be another colour like the first display section 32, by way of example red. The visibility of this second display section 34 makes it known from the outside that a triggering procedure has occurred.

The return element 122 is achieved as a helical resilient element. The return element is held axially on the hub 115. A first resilient arm 123 is curved in a radially free-standing manner. The resilient arm supports itself on the blocking lever 118. A second resilient arm 124 is likewise bent in a radially free-standing manner, said second resilient arm supporting itself on a pin 24. The arrow P2 in the FIGS. 4 and 6 indicates the direction of the returning resilient force that is exerted by the return element 122 on the operating means 113. The returning resilient force attempts to pivot the operating means 113 back into the release position after being deflected into the operating position.

Figure 5:
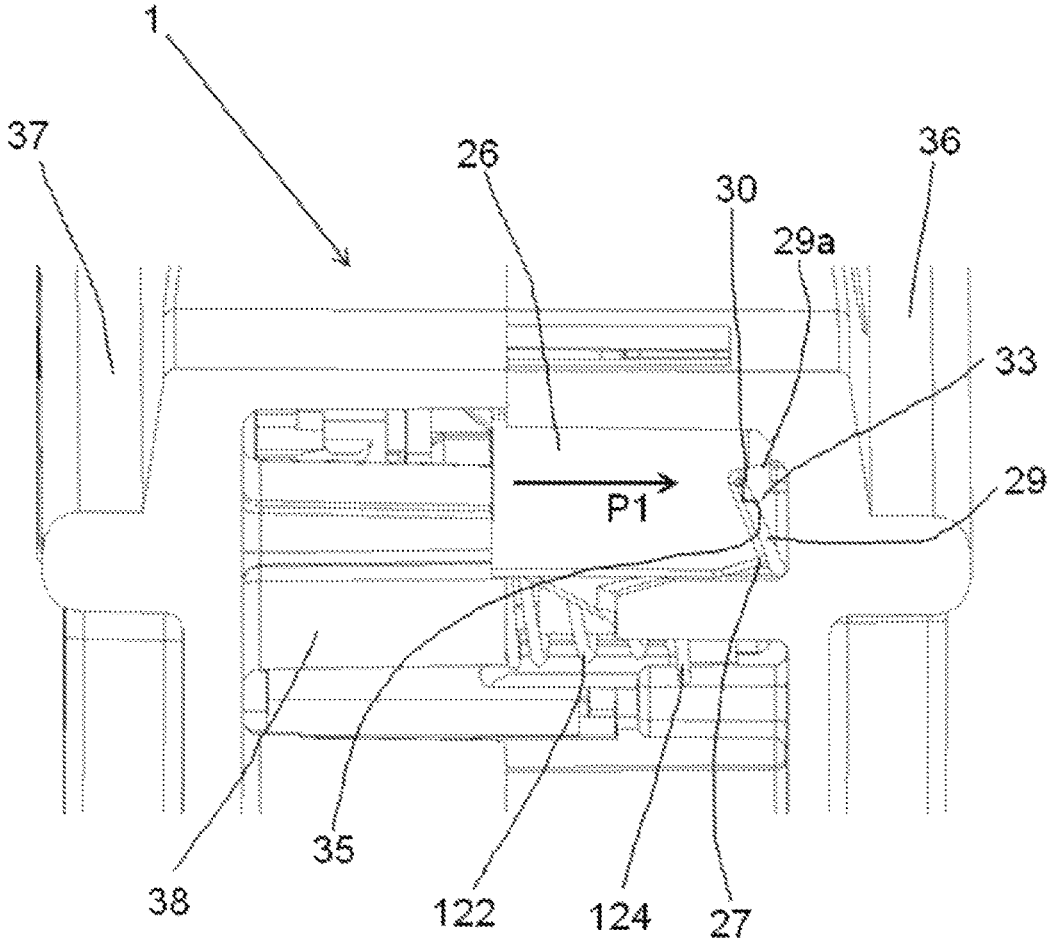
FIG. 5 a view of the in part cut away front face of an installation switching device in accordance with the second embodiment of the invention, in the region of the operating means, wherein the switching knob is located in the switched-off position.

In FIG. 5 it is evident that a further latching site is formed between the housing inner face and the edge of the display carrier 26 that points towards the housing inner face. For this purpose, a ramp-shaped formation 34 protrudes from the housing inner face into the interior of the housing. The formation has a longer and a shorter inclined surface 29, 29*a*. A housing-side latching lug 30 is formed on the joining edge at which said inclined surfaces meet. Corresponding to the ramp-shaped formation 34, a saw tooth-shaped, contoured recess 35 is formed on the edge of the display carrier 26 that points towards the housing inner face. The formation also has a longer and a shorter inclined surface. The longer inclined surface has the function of an operating means-side run-off surface 28. The starting region of the operating means-side run-off surface 28 forms an inclined operating means-side latching lug 27.

The function of the second latching site is as follows. In the release position of the operating means 113 see FIGS. 4 and 5, the operating means-side latching lug 27 is located near to the lower starting point of the housing-side run-off surface 29 of the ramp-shaped formation 33. The second latching site is not latched. If the operating means 113 is pivoted anticlockwise out of its release position into its operating position see FIGS. 6 and 7, the operating means-side latching lug 27 is forced to run-off along the housing-side run-off surface 29. As a consequence, the operating means 113 is initially forced inwards, away from the housing outer side, opposite the returning resilient force of the helical resilient element 122. If the operating means-side latching lug 27 is then pushed away by way of the housing-side latching lug 30 during the course of further pivoting the operating means 113, the returning resilient force of the helical resilient element 122 ensures that the operating means 113 is again pushed axially in the direction of the arrow P1 to the housing inner face. The operating means-side latching lug 27 thereby moves behind the housing-side latching lug 30 and the second latching site is thereby latched. The operating means 113 is held in its operating position owing to the latching of the second latching site.

The helical resilient element 122 consequently has a dual function. Firstly, said helical resilient element ensures the returning resilient force is applied in order to influence the operating means 113 out of its operating position back in the direction of its release position. Secondly, said helical resilient element ensures that if the operating means 113 is located in its operating position, the second latching site latches.

The helical resilient element 122 is pre-stressed with a returning resilient force when installing the housing. If the housing, as is illustrated in the exemplary embodiment, is a shell housing and is formed from two housing half shells 36, 37 that are combined along a joining edge that extends parallel to the housing broad sides, by way of example the operating means 113 having the helical resilient element 122 coupled thereto is thus inserted into the first housing half shell 36 as a pre-assembled construction unit see FIG. 8, and is thereby pushed onto the pivot axis 14. At the site that lies opposite the pivot axis 14, the second housing half shell 37 supports a pin 38 that is at least hollow on its free end. Said pin receives the free end of the pivot axis 14 and pushes the helical resilient element 122 together with its wall a little further in order to consequently cause a corresponding pre-stressing of the helical resilient element 122.

In order to switch the installation switching device from the triggered position, the switching knob 2 must initially be manually brought into its switched-off position see FIG. 4. The operating contour 17 on the switching knob 2 overcomes the blocking arrangement by means of the latching projection 119 on the operating means 113. The switching knob simultaneously also pushes the operating means-side latching lug 27 by way of the operating contour 17 back over the housing-side latching lug 30 and unlatches the second latching site so that the operating means 113 can move, driven by means of the returning resilient force of the helical resilient element 122, into its release position see FIG. 4.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

1 Installation switching device
2 Switching knob
3 Front face
4 Pivot axis
5 Trigger lever
6 Further lever, latching lever
7 Switching grip
8 Projection on the switching knob
9 Eye-shaped aperture
10 Link element
11 Elongated hole
12 Intermediate lever
13 Operating means
14 Pivot axis of the operating means, said pivot axis being fixed to the housing
15 Hub
16 Longitudinal central axis
17 Operating contour
18 Blocking lever
19 Latching projection
20 Actuating lever
21 Actuating projection

22 Return element
23 Free end of the returning element
24 Pin that is fixed to the housing
25 Rounded edge
26 Display carrier
27 Operating means-side latching lug
28 Operating means-side run-off surface
29 Housing-side run-off surface
29*a* Shorter inclined surface
30 Housing-side latching lug
31 Viewing window
32 First display section
33 Ramp-shaped formation
34 Second display section
35 Saw tooth-shaped contoured recess
36 First housing half shell
37 Second housing half shell
38 Pin
113 Operating means
115 Hub
116 Central hole
118 Blocking lever
119 Latching projection
120 Actuating lever
121 Actuating projection
122 Return element
123 First arm
124 Second arm

The invention claimed is:

1. An electrical installation switching device, comprising:
an insulating material housing;
a switching knob protruding beyond the insulating material housing on a front face of the insulating material housing, the switching knob configured to pivot between a switched-on position and a switched-off position about a first pivot axis;
a switching lock including a first latching site, the switching lock being triggerable in the event of an excess current and/or short circuit current to unlatch the first latching site; and
an operator configured to pivot between a release position and an operating position about a second pivot axis, the second pivot access being aligned parallel to the first pivot axis,
wherein the switching knob includes an operating contour,
wherein the operator and the operating contour cooperate in the event of the switching lock being triggered by the excess current and/or the short circuit current when the operator is pivoting about the second pivot axis so as to hold the switching knob in an intermediate position between the switched-on position and the switched-off position,
wherein the operator comprises a double arm lever that is mountable in such a manner that it can pivot, and a first lever arm of the double arm lever supports, on a free end of the first lever arm, a latching projection as a coupling site configured to cooperate with the operating contour of the switching knob,
wherein a second lever arm of the double arm lever forms an obtuse angle with the first lever arm and a free end of the second lever arm forms a coupling site configured to operatively couple to the switching lock, and
wherein the operator includes a display carrier, including a first display section and a second display section, configured to display at least two different positions of the operator.

2. The device of claim 1, wherein the operator is coupled to a return element that exerts a returning resilient force on the operator, and
wherein the returning resilient force returns the operator in a direction of the release position of the operator.

3. The device of claim 1, wherein the return element is fixedly connected to the operator and is formed with an S-shaped, folded, elastically deformable, strip material.

4. The device of claim 1, further comprising:
a viewing window, attached to the front face of the housing in a region of the display carrier so as to view at least one of the display sections.

5. The device of claim 1, further comprising:
a second latching site, arranged between the housing and the operator,
wherein the operator is held in its operating position by being latched at the second latching site.

6. The device of claim 5, wherein the return element is configured to influence the operator with a returning resilient force in a direction of the release position of the operator, and
wherein the return element is configured to influence the operator with an axially-acting resilient force into the latching position of the second latching site.

7. The device of claim 6, wherein the return element includes a helical resilient element including a first and a second operating arm that in each case protrude at an end in a radial manner.

8. The device of claim 6, further comprising:
a ramp-shaped formation, including a housing-side latching lug, protruding from an inner face of the housing into an interior of the housing so as to form the second latching site; and
a saw tooth-shaped, contoured recess, corresponding to the ramp-shaped formation, including an inclined operator-side latching lug, formed on an edge of the display carrier, that points towards the housing's inner face.

* * * * *